US009016081B2

(12) United States Patent
Goldstein

(10) Patent No.: US 9,016,081 B2
(45) Date of Patent: Apr. 28, 2015

(54) METHOD AND APPARATUS FOR COOLING FOODSTUFF

(75) Inventor: Vladimir Goldstein, Woodbridge (CA)

(73) Assignee: Sunwell Engineering Company Limited, Ontario (CA)

( * ) Notice: Subject to any disclaimer, the term of this patent is extended or adjusted under 35 U.S.C. 154(b) by 1720 days.

(21) Appl. No.: 12/310,906

(22) PCT Filed: Sep. 12, 2007

(86) PCT No.: PCT/CA2007/001599
§ 371 (c)(1),
(2), (4) Date: Apr. 11, 2011

(87) PCT Pub. No.: WO2008/031206
PCT Pub. Date: Mar. 20, 2008

(65) Prior Publication Data

US 2011/0179812 A1 Jul. 28, 2011

(30) Foreign Application Priority Data

Sep. 12, 2006 (CA) ..... 2562722

(51) Int. Cl.

| | |
|---|---|
| ***B65B 63/08*** | (2006.01) |
| ***G01K 13/00*** | (2006.01) |
| ***F25D 17/02*** | (2006.01) |
| ***F25D 3/02*** | (2006.01) |
| ***F25D 25/00*** | (2006.01) |

(52) U.S. Cl.
CPC ..... *F25D 3/02* (2013.01); *F25C 2301/002* (2013.01); *F25D 17/02* (2013.01); *F25D 25/005* (2013.01)

(58) Field of Classification Search
CPC ..... F25D 17/02; F25D 25/00; F25D 25/005
USPC ..... 62/60, 62, 64, 63, 373, 376, 135–137, 62/130, 374, 375
See application file for complete search history.

(56) References Cited

U.S. PATENT DOCUMENTS

| | | | | |
|---|---|---|---|---|
| 1,527,562 | A * | 2/1925 | Kolbe | 62/64 |
| 2,513,004 | A * | 6/1950 | Cooley | 114/74 R |
| 2,640,333 | A | 6/1953 | Bailey | |
| 2,930,707 | A * | 3/1960 | Linnell et al. | 426/124 |
| 3,004,407 | A * | 10/1961 | Morris, Jr. | 62/374 |

(Continued)

FOREIGN PATENT DOCUMENTS

| | | |
|---|---|---|
| CA | 2 563 170 | 10/2004 |
| EP | 0 846 928 | 6/1998 |

(Continued)

OTHER PUBLICATIONS

Office Action for Canadian Application No. 2,562,722 dated Oct. 5, 2012.

*Primary Examiner* — Mohammad M Ali
*Assistant Examiner* — Christopher R Zerphey
(74) *Attorney, Agent, or Firm* — Harness, Dickey & Pierce, P.L.C.

(57) ABSTRACT

A method of cooling foodstuff comprises immersing at least one perforated container containing foodstuff into an ice slurry bath for a period of time sufficient to allow ice slurry to enter the at least one perforated container and then subsequently removing the at least one perforated container from the ice slurry bath. Various apparatuses for cooling foodstuff are also provided.

15 Claims, 10 Drawing Sheets

(56) References Cited

U.S. PATENT DOCUMENTS

| | | | | | |
|---|---|---|---|---|---|
| 3,071,045 | A | * | 1/1963 | Budd | 493/89 |
| 3,395,549 | A | | 8/1968 | Grimes | |
| 3,575,010 | A | | 4/1971 | Honeyman | |
| 4,380,908 | A | | 4/1983 | Crabb, Jr. | |
| 4,425,768 | A | * | 1/1984 | Burns | 62/237 |
| 4,484,448 | A | * | 11/1984 | Crabb, Jr. | 62/64 |
| 4,796,441 | A | | 1/1989 | Goldstein | |
| 4,936,102 | A | | 6/1990 | Goldstein | |
| 4,996,441 | A | | 2/1991 | Goldstein | |
| 5,598,716 | A | * | 2/1997 | Tanaka et al. | 62/185 |
| 5,884,501 | A | | 3/1999 | Goldstein | |
| 6,056,046 | A | | 5/2000 | Goldstein | |
| 6,286,332 | B1 | | 9/2001 | Goldstein | |
| 2005/0279107 | A1 | * | 12/2005 | Vinberg | 62/64 |

FOREIGN PATENT DOCUMENTS

| | | |
|---|---|---|
| WO | WO 88/03251 | 5/1988 |
| WO | WO 94/04879 | 3/1994 |

* cited by examiner

METHOD AND APPARATUS FOR COOLING FOODSTUFF

This application is the national phase under 35 U.S.C. §371 of PCT International application Ser. No. PCT/CA2007/001599 which has an International filing date of Sep. 12, 2007, which claims priority to Canadian Patent application No. CA 2562722 filed Sep. 12, 2006; the entire contents of each of which are hereby incorporated by reference.

FIELD OF THE INVENTION

The present invention relates to a method and apparatus for cooling foodstuff.

BACKGROUND OF THE INVENTION

As is well known, in many environments to preserve freshness and inhibit spoiling, foodstuff is often cooled or chilled prior to serving and/or shipping. For example, fishing vessels typically carry refrigeration equipment to allow fish to be chilled as the fish are caught. In this manner, the fish does not spoil and remains edible even over lengthy voyages. Vegetables that are transported by truck or rail are also typically refrigerated during transit to prevent spoiling. Many refrigeration techniques have been employed and include for example, air conditioning units and ice-making machines that produce ice. In the latter case, ice-making machines that produce a slurry of fine ice crystals in a solution have been used to chill food product such as fish and vegetables.

One exemplary type of ice-making machine of this type is disclosed in U.S. Pat. No. 4,796,441 to Goldstein, assigned to the assignee of the subject application, the content of which is incorporated herein by reference. This ice-making machine has a chamber with a fluid inlet to receive a brine solution from which ice is to be made and a fluid outlet to permit the egress of an ice-brine slurry from the chamber. The interior surface of the chamber defines a heat exchange surface. A tubular jacket surrounds the chamber. A refrigerant inlet and a refrigerant outlet communicate with the space between the jacket and chamber and are positioned at opposite ends of the ice-making machine. Refrigerant flowing through the space between the inlet and the outlet boils and in so doing, cools the brine solution in contact with the heat exchange surface. Refrigerant leaving the ice-making machine via the outlet is condensed and compressed before being fed back to the refrigerant inlet. A blade assembly is mounted on a rotatable shaft extending through the center of the chamber and is in contact with the heat exchange surface. A motor rotates the shaft so that the blade assembly removes a cooled layer of brine solution in contact with the heat exchange surface and directs the removed cooled layer into a body of brine solution within the chamber. The shaft is rotated at a rate such that the interval between successive passes of the blade assembly over the heat exchange surface inhibits the formation of ice crystals on the heat exchange surface.

Alternatively, the ice-making machine may be of the type disclosed in U.S. Pat. Nos. 5,884,501, 6,056,046 and 6,286,332 to Goldstein and assigned to the assignee of the subject application, the content of which is incorporated herein by reference. This ice-making machine includes a housing having a brine solution inlet to receive brine solution from which ice is to be made and an ice-brine slurry outlet to permit the egress of an ice-brine slurry from the housing. A heat exchanger within the housing has a heat exchange surface, a refrigerant inlet, a refrigerant outlet and at least one refrigerant circuit interconnecting the refrigerant inlet and the refrigerant outlet. Refrigerant flows through the at least one refrigerant circuit between the refrigerant inlet and the refrigerant outlet to extract heat from the brine solution contacting the heat exchange surface. A blade assembly within the housing carries a plurality of blades, each of which is in contact with the heat exchange surface. The blade assembly is mounted on a shaft, which is rotated by a motor at a rate such that the blades move across the heat exchange surface and remove cooled fluid therefrom thereby to inhibit the deposition of ice crystals on the heat exchange surface.

U.S. Pat. No. 4,936,102 to Goldstein et al., assigned to the assignee of the subject application, discloses an apparatus for cooling fish on board a ship employing for example, an ice-making machine of the type disclosed in aforementioned U.S. Pat. No. 4,796,441. The outlet of the ice-making machine is connected to a pump leading to a flexible hose. The flexible hose can be carried either to a vessel containing salt water or to a catch of fish to direct ice slurry produced by the ice-making machine directly to the catch of fish or to the vessel.

Depending on the product to be cooled and its packaging, delivering ice slurry such as that produced by the ice-making machines described above, can present challenges. For example, it is known to use a manifold to direct an incoming ice slurry to a plurality of stacked, perforated containers simultaneously. For example, FIGS. 1*a* and 1*b* show top and side elevational views of such a manifold 100. As can be seen, the manifold 100 is in abutment with one side of a rectangular array of stacked perforated containers 110 that are filled with foodstuff and that rests on a pallet 120. During cooling of the foodstuff in the containers 110, ice slurry is delivered to the inlet of the manifold 100. The ice slurry in turn is discharged by the manifold 100 toward each row of containers 110 via its outlets. Discharged ice slurry in turn enters the containers 110 via the perforations therein. The foodstuff in the containers 110 acts as a filter, trapping ice crystals while allowing the liquid portion of the ice slurry to drain and exit the containers 110 through the perforations. In this manner, the containers 110 become packed with ice crystals. Unfortunately, during this process it is very difficult, if not impossible, to control the amount of ice deposited in each container 110. As each container needs to be packed with ice, this uncertainty can be problematic.

It is therefore an object of the present invention to provide a novel method and apparatus for cooling product.

SUMMARY OF THE INVENTION

Accordingly, in one aspect there is provided an apparatus for cooling foodstuff comprising:

a tank containing an ice slurry bath, said tank being sized to receive a stack of perforated containers containing foodstuff with said stack of containers being immersed in said ice slurry bath; and at least one agitator to agitate the ice slurry bath.

In one embodiment, the at least one agitator is positioned in the tank within the ice slurry bath. The at least one agitator may comprise for example at least one rotating paddle. Alternatively, the at least one agitator may comprise at least one nozzle discharging ice slurry into the tank. In this latter case, a pump draws ice slurry from the tank and delivers the ice slurry to the at least one nozzle. The at least one nozzle may be positioned in the tank within the ice slurry bath or in the tank above the ice slurry bath. A sensor to monitor the ice fraction of the ice slurry bath within the tank may also be provided.

According to another aspect there is provided an apparatus for cooling foodstuff comprising:

at least one tank containing an ice slurry bath and adapted to receive foodstuff to be cooled;

at least one nozzle within said tank to receive ice slurry and discharge said ice slurry into said tank; and at least one pump to draw ice slurry from said ice slurry bath and deliver the ice slurry to said at least one nozzle.

In one embodiment, the at least one nozzle is positioned above the ice slurry bath. Foodstuff received by the tank is immersed in the ice slurry bath. At least one support frame may be provided within the tank onto which foodstuff is placed. In this case, the at least one support frame comprises individual foodstuff compartments and may be oscillated within the tank.

In an alternative embodiment, the at least one nozzle discharges ice slurry onto foodstuff suspended above the ice slurry bath.

In yet another embodiment, the apparatus comprises a plurality of stacked tanks, with each tank containing an ice slurry bath and at least one nozzle. The at least one pump delivers ice slurry to at least one of the nozzles. For example, the at least one pump may deliver ice slurry to the at least one nozzle of the uppermost tank in the stack with the nozzles of other tanks of the stack receiving ice slurry from overhead tanks. An oscillator may be provided to oscillate the stack of tanks.

According to yet another aspect there is provided an apparatus for cooling foodstuff comprising:

a tank adapted to receive foodstuff to be cooled and receiving a supply of ice crystals; and at least one manifold within said tank having a plurality of outlets, said manifold receiving a supply of inlet air and discharging received air via said outlets in a manner to suspend ice crystals and create a fluidized ice crystal bed within said tank.

In one embodiment, the apparatus further comprises at least one blower drawing at least air from an intake port coupled to the tank and supplying air to the at least one manifold. The blower may draw both air and ice crystals from the tank.

According to still yet another aspect there is provided an apparatus for cooling foodstuff comprising:

a rotating drum comprising an inlet receiving foodstuff to be cooled and an outlet to discharge cooled foodstuff, said drum further comprising an ice crystal inlet receiving a supply of ice crystals; and a foodstuff advancing mechanism to advance foodstuff from said inlet to said outlet as said drum rotates.

In one embodiment, the foodstuff advancing mechanism comprises formations on an interior surface of the drum that are shaped to advance the foodstuff. The drum may further comprise at least one drainage passage and may be inclined in a direction from the inlet to the outlet.

According to still yet another aspect there is provided a method of cooling foodstuff comprising:

immersing at least one perforated container containing foodstuff into an ice slurry bath for a period of time sufficient to allow ice slurry to enter said at least one perforated container; and then subsequently removing said at least one perforated container from said ice slurry bath.

According to still yet another aspect there is provided a method of cooling foodstuff comprising:

exposing foodstuff to ice crystals to cool said foodstuff; and agitating said ice crystals at least during said exposing.

The apparatus and method promote rapid cooling of foodstuff and generally achieve uniform contact between ice crystals and the foodstuff. Further, the apparatus allows the volume of the ice crystals surrounding the foodstuff to be controlled. These are important factors in the process of preservation and transportation of foodstuff.

BRIEF DESCRIPTION OF THE DRAWINGS

Embodiments will now be described more fully with reference to the accompanying drawings in which.

DETAILED DESCRIPTION OF THE EMBODIMENTS

Figure 1A:
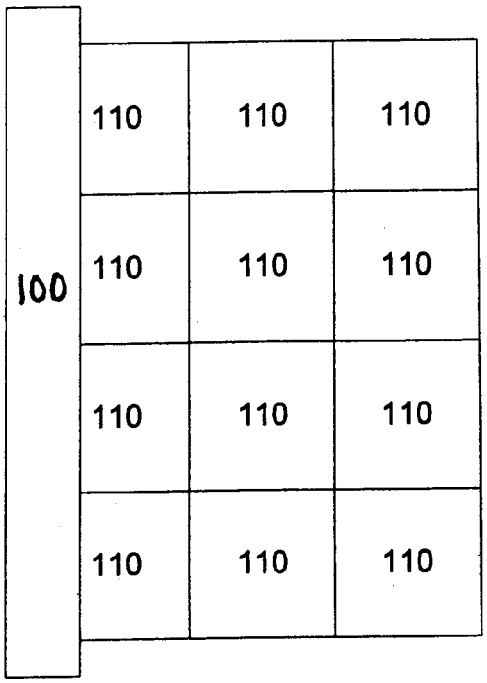
Figure 1a (Prior Art)
FIGS. 1*a* and 1*b* are top plan and side elevational views of a prior art container cooling technique.
Figure 1B:
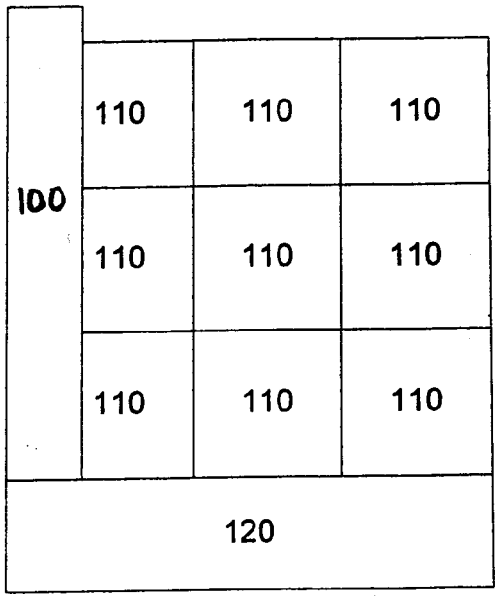
Figure 1b (Prior Art)
Figure 2A:
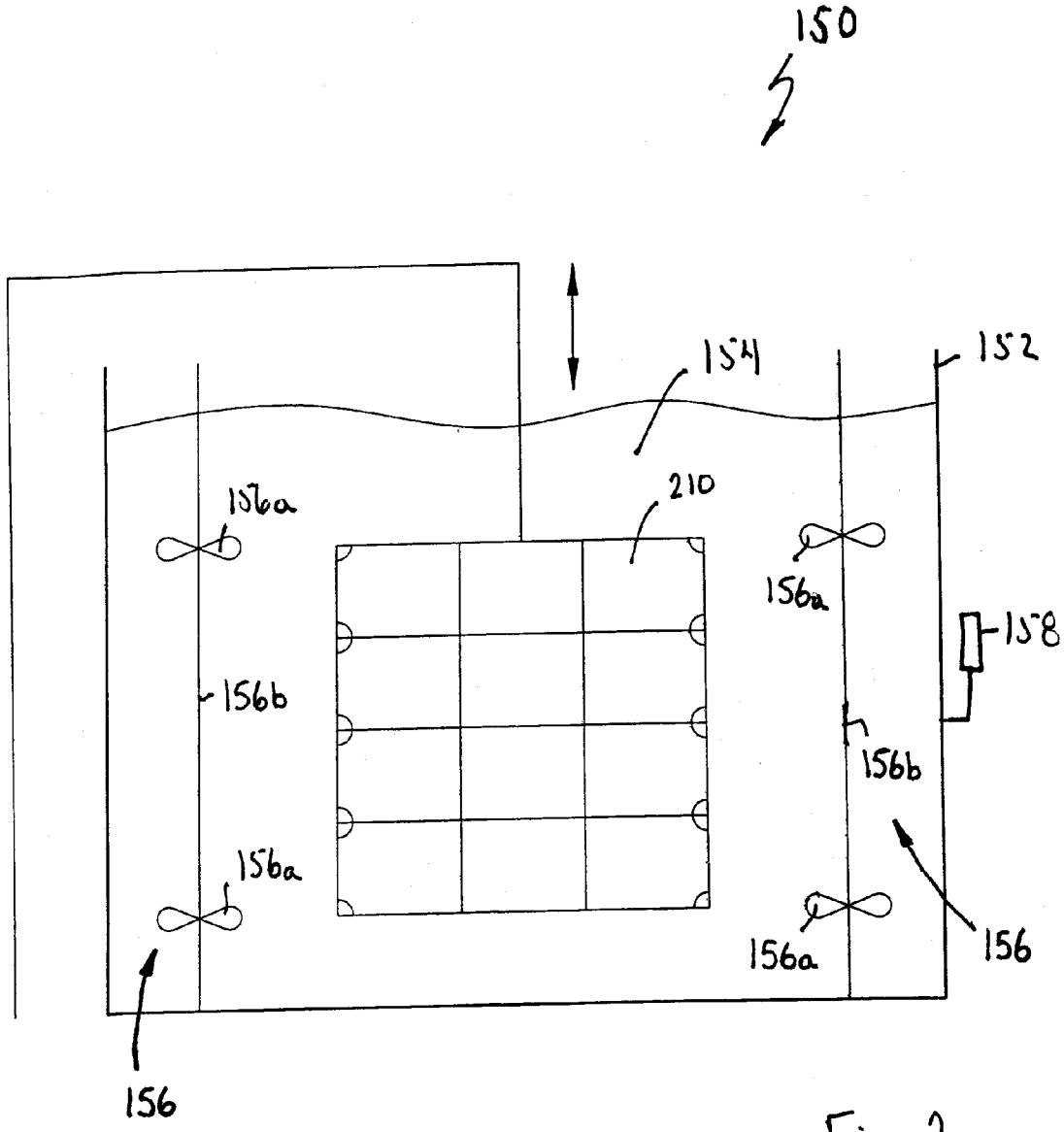
FIGS. 2*a* and 2*b* are side elevational views of an apparatus for cooling product.
Figure 2B:
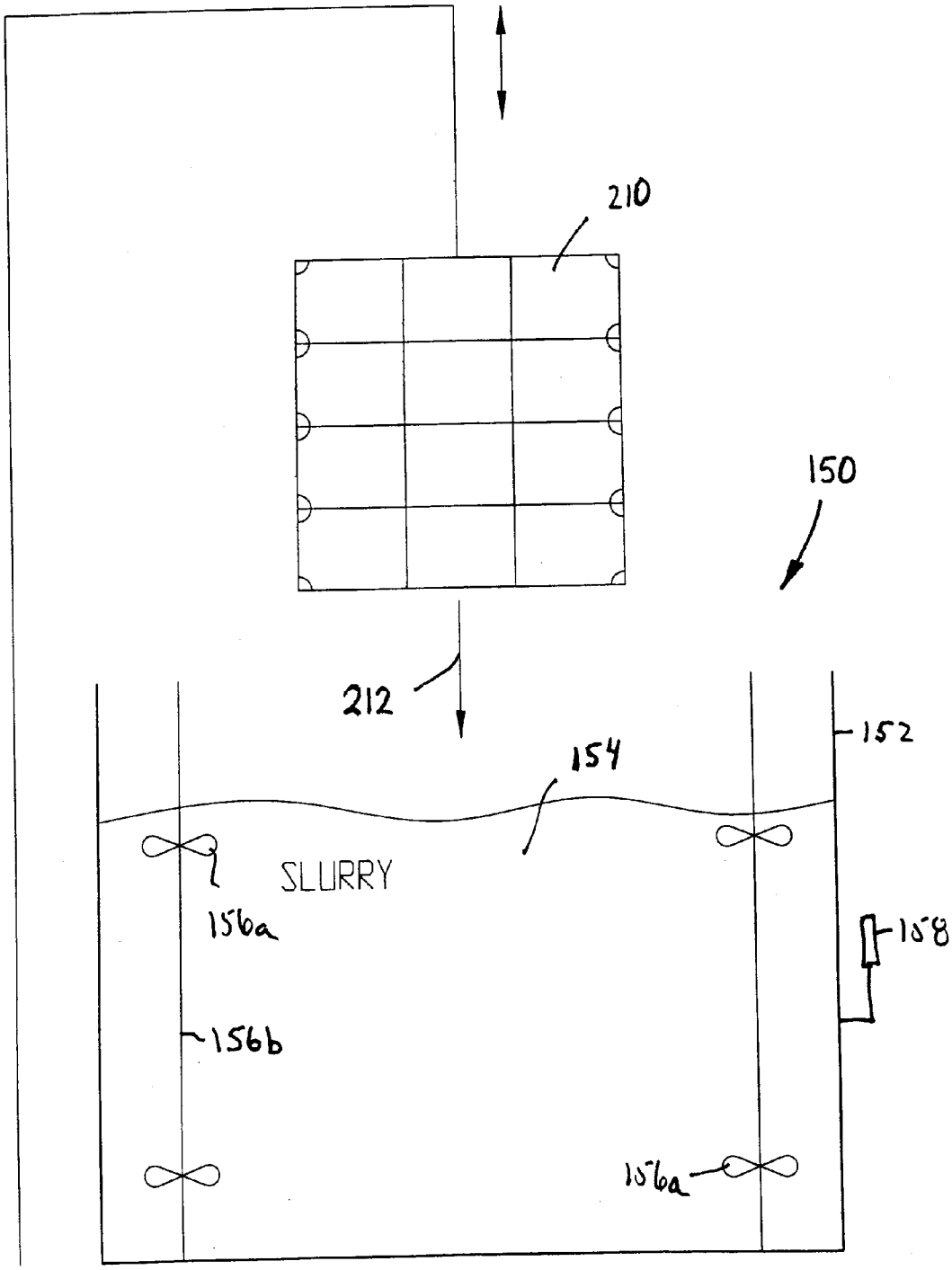

Turning now to FIGS. 2*a* and 2*b*, an apparatus for cooling product held in containers, such as for example perforated boxes, is shown and is generally identified by reference numeral 150. In this embodiment, the apparatus 150 comprises an opened top tank 152 filled with an ice slurry bath 154. The ice slurry bath 154 may be produced by one of the ice-making machines described above or may simply be crushed ice and water. Agitators 156 are provided adjacent at least two sides of the tank 152 to maintain the ice slurry bath 154 in the tank in an agitated state thereby to inhibit conglomeration of ice crystals and ensure a general even distribution of ice crystals throughout the ice slurry bath 154. The agitators 156 are in the form of blades on paddles 156*a* mounted on upright rotating shafts 156*b* at different elevations. One or more motors (not shown) are coupled to the shafts 156*b* either directly or via gear trains (not shown) to rotate the shafts. A sensor 158 including a calorimeter is mounted on the tank 152 to sense the ice fraction of the ice slurry bath 154 within the tank 152. When the sensor 158 detects that the ice fraction of the ice slurry bath in the tank 152 has dropped below a threshold level, the sensor provides an output signal which is used to control operation of ice-making equipment so that ice crystals are added to the ice slurry bath 154 thereby to increase the ice fraction until it reaches the desired level. For example, the signal from the sensor 158 may be used to actuate an ice storage and distribution unit such as that disclosed in U.S. Pat. No. 4,912,935 to Goldstein, assigned to the assignee of the subject application, the content of which is incorporated herein by reference, resulting in ice flakes being discharged from the ice storage and distribution unit into the tank 152.

The tank 152 is sized to accommodate a stack of perforated containers filled with foodstuff allowing the entire stack to be submersed in the ice slurry bath 154. In this manner, the foodstuff in a plurality of containers 210 can be chilled simultaneously allowing the apparatus 150 to maintain an effective throughput. During use as shown in FIG. 2*a*, the stack of the containers 210 is lowered into the tank 152 and immersed in the ice slurry bath 154. Once immersed, ice slurry flows into the containers 210 through the perforations therein until the containers are flooded with ice slurry. Agitation of the ice slurry helps to establish a generally continuous flow of ice slurry through the containers 210.

As stated previously, the foodstuff in the containers 210 acts as a filter trapping ice crystals resulting in the containers becoming packed with ice crystals. The stack of containers 210 is typically allowed to sit immersed in the ice slurry bath 154 for a period of time sufficient to ensure the containers become generally packed with ice crystals. By immersing the entire stack of containers 210 in the ice slurry bath 154 and agitating the ice slurry bath 154, an even distribution of ice crystals within the containers 210 of the stacks is generally maintained.

Following this, the stack of containers 210 is lifted from the ice slurry bath 154 as shown in FIG. 2*b*, allowing the liquid portion of the ice slurry to drain out of the containers 210 through the perforations and back into the tank 152 as shown by arrow 212, leaving the ice crystals trapped inside the containers 210. In order to immerse and remove the stack of containers 210 from the ice slurry bath 154, a lift (not shown) such as a forklift or a conveyer line is employed.

As will be appreciated, as the ice fraction of the ice slurry bath 154 is monitored by the sensor 158, the amount of ice crystals trapped within the containers 210 can be determined by measuring the drop in the ice fraction of the ice slurry bath upon removal of the stack of containers. In this manner the amount of ice crystals trapped in the containers 210 can be controlled by adjusting the period of time in which the stack of containers 210 is allowed to sit immersed in the ice slurry bath 154, by controlling the extent of ice slurry bath agitation and/or by adjusting the ice fraction of the ice slurry bath.

The volume of the ice crystals trapped inside the containers 210 may be increased by dipping the stack of containers 210 into the ice slurry bath 154 repeatedly. Depending on the foodstuff to the chilled, performance of the apparatus 150 may be further enhanced by varying the ice crystals of the ice slurry bath 154 and/or by changing the chemical composition of the ice slurry bath. For example, salt may be added to the ice slurry bath 154 and/or the ice crystal size may be changed to alter the flow characteristics of the ice slurry bath.

Funnels or traps can also be placed strategically around the stack of containers 210 so that when the stack of containers is lifted from the ice slurry bath, ice slurry flows downwardly through the stack of containers from top to bottom. Proper positioning of such devices helps to achieve a more uniform distribution of the ice crystals throughout the stack of containers. Different distributions of perforations in containers 210 may also be used to effect ice crystal distribution.

If desired, the ice slurry bath may be treated so that foodstuff in the containers 210 is washed and sterilized when immersed in the ice slurry bath 154. For example, ozone, chlorine or other subtle additives may be added to the ice slurry bath. Alternatively, in addition fine gas bubbles may be introduced into the ice slurry bath 154 to lift dirt or other contaminants from the foodstuff.

As will be appreciated, unlike the prior art, the apparatus 150 allows the volume of ice crystals that remains in the containers 210 to be controlled and ensures intimate contact between foodstuff in the containers and ice crystals. The immersion process also inhibits mechanical damage to foodstuff during the icing process, as the foodstuff typically floats in the ice slurry bath 154 during the icing process. In conventional methods, foodstuff may be crushed by ice.

Figure 3:
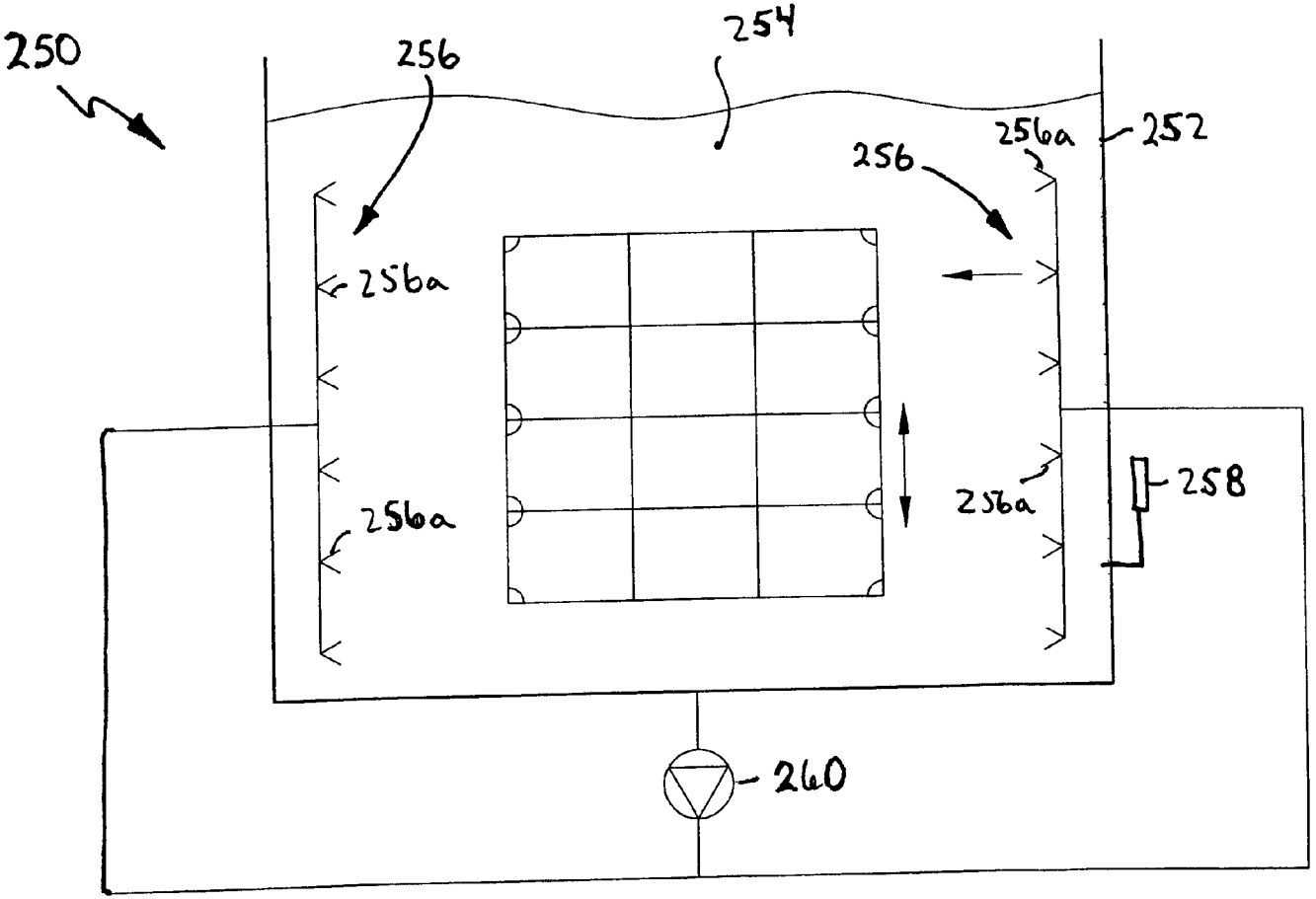
FIG. 3 is a side elevational view of an apparatus for chilling product.

FIG. 3 shows an alternative apparatus 250 for chilling product such as foodstuff very similar to that of FIGS. 2*a* and 2*b*. In this embodiment, the apparatus similarly comprises a tank 252 filled with an ice slurry bath 254. Rather than employing agitators, nozzle assemblies 256 are provided adjacent at least two sides of the tank 252. Each nozzle assembly 256 has a series of nozzles 256*a* pointing inwardly towards the center of the tank 252. A pump 260 has an inlet coupled to a drain adjacent the bottom of the tank 252 and an outlet coupled to the nozzle assemblies 256. In this manner, ice slurry in the tank 252 is circulated from the tank through the pump 260 and to the nozzle assemblies 256. The ice slurry is in turn discharged by the nozzles 256*a* towards the center of the tank 252 to maintain the ice slurry bath 254 in an agitated state. To enhance distribution of ice slurry, deflectors can be positioned within the tank to direct ice slurry exiting the nozzles 256*a* either towards or away from the stack of containers. A sensor 258 including a calorimeter is similarly mounted on the tank 252 to sense the ice fraction of the ice slurry bath 254 within the tank.

The operation of the apparatus 250 is virtually identical to that of apparatus 150. Stacks of containers 210 are immersed in the ice slurry bath 254 so that the ice slurry enters the containers 210 resulting in ice crystals being trapped within the containers. As will be appreciated, use of the nozzle assemblies 256 increases the degree of agitation of the ice slurry bath 254 and hence ice slurry flow through the containers 210. This enables the containers to be more densely packed with ice crystals or the throughput of the apparatus to be increased as compared to apparatus 150.

If desired, agitators similar to those shown in FIGS. 2*a* and 2*b* can be used in conjunction with the nozzle assemblies 256.

For the embodiments of FIGS. 2*a*, 2*b* and 3, rather than employing agitators or nozzle assemblies to agitate the ice slurry bath, the ice slurry bath can also be agitated through movement of the stack of containers within the tank.

Figure 4A:
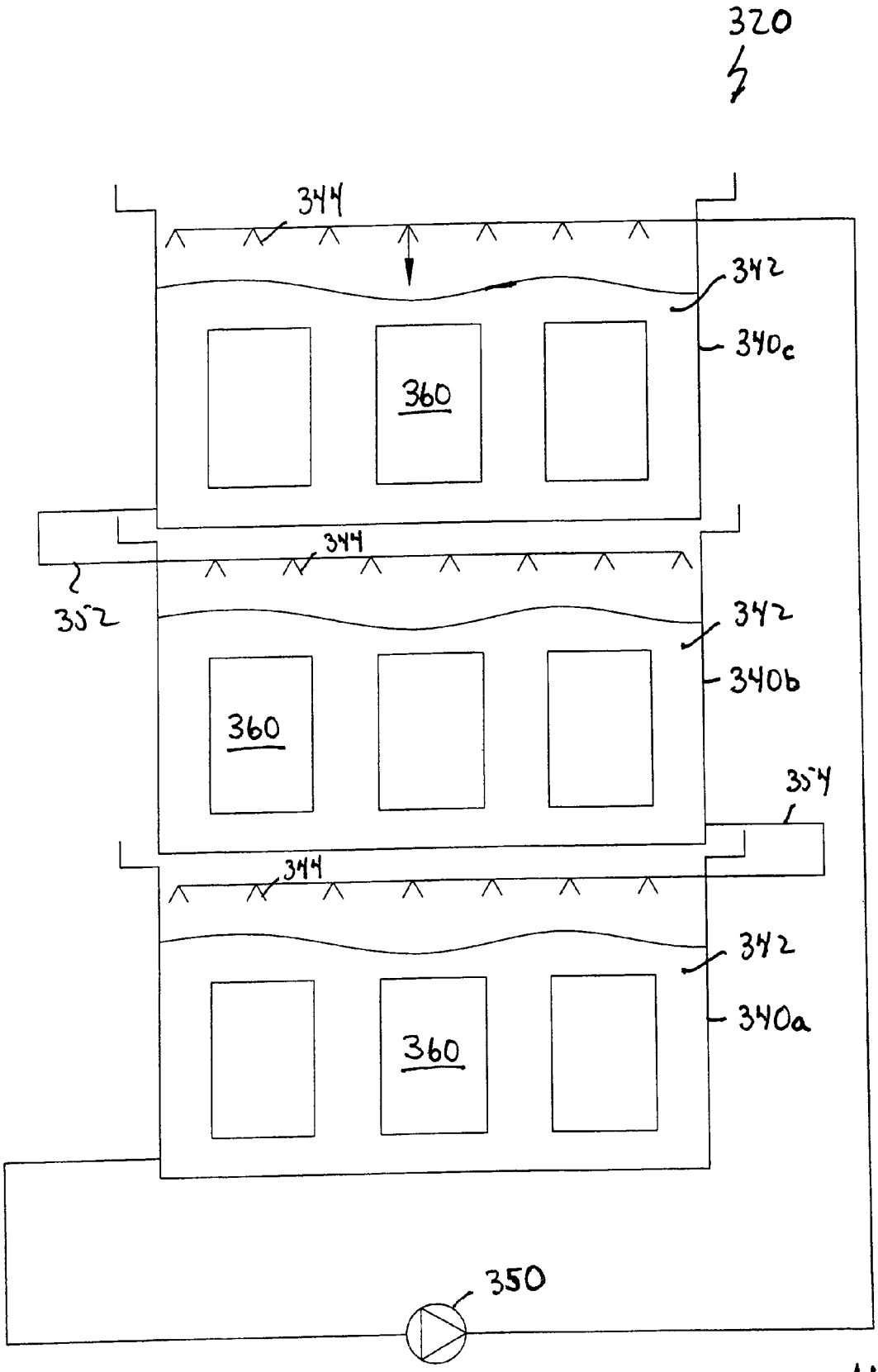
FIG. 4*a* is a side elevational view of another embodiment of an apparatus for cooling product.

Turning now to FIG. 4*a*, another apparatus for cooling product is shown and is generally identified by reference numeral 320. The apparatus 320 is best suited for chilling foodstuff with high thermal mass and low thermal conductivity. Cooling of such foodstuff requires a longer time and is generally limited not by the heat transfer from the ice slurry, but by the internal flow of heat. As can be seen, the apparatus 320 comprises a plurality of stacked tanks 340*a* to 340*c*, each tank of which is filled with an ice slurry bath 342. The ice fraction of each ice slurry bath 342 is adjusted to meet specific cooling and heat transfer requirements by monitoring the ice fraction of the ice slurry bath in each tank using for example sensors of the type described above and introducing ice into the ice slurry baths when appropriate. The temperature of the ice slurry baths 342 can also be adjusted by changing the concentration of temperature depressants in the ice slurry baths 342.

A nozzle assembly 344 having a series of nozzles 344*a* is provided adjacent the top of each tank 340*a* to 340*c* and sprays ice slurry into its associated tank. A pump 350 has its inlet coupled to a drain adjacent the bottom tank 340*a* and its outlet coupled to the nozzle assembly 344 of the uppermost tank 340*c*. A conduit 352 extending from the base of the top tank 340*c* supplies ice slurry to the nozzle assembly 344 of the middle tank 340*b* under the influence of gravity. Similarly, a conduit 354 extending from the base of the middle tank 340*b* supplies ice slurry to the nozzle assembly 344 of the bottom tank 340*a* under the influence of gravity.

During use, foodstuff 360 is placed into the ice slurry baths 342. The foodstuff 360 may have a surface package or by its specific nature, may resist mixing with the ice slurry baths 342. In any event, cooling occurs predominantly by contact between the ice slurry baths 342 and the outer surfaces of the foodstuff 360 and by conduction within the foodstuff 360. To enhance heat transfer between the foodstuff 360 and the ice slurry baths 342, the levels of the ice slurry baths within the tanks 340*a* to 340*c* can be varied. Also, small agitation devices can be provided in the tanks 340*a* to 340*c*.

Figure 4B:
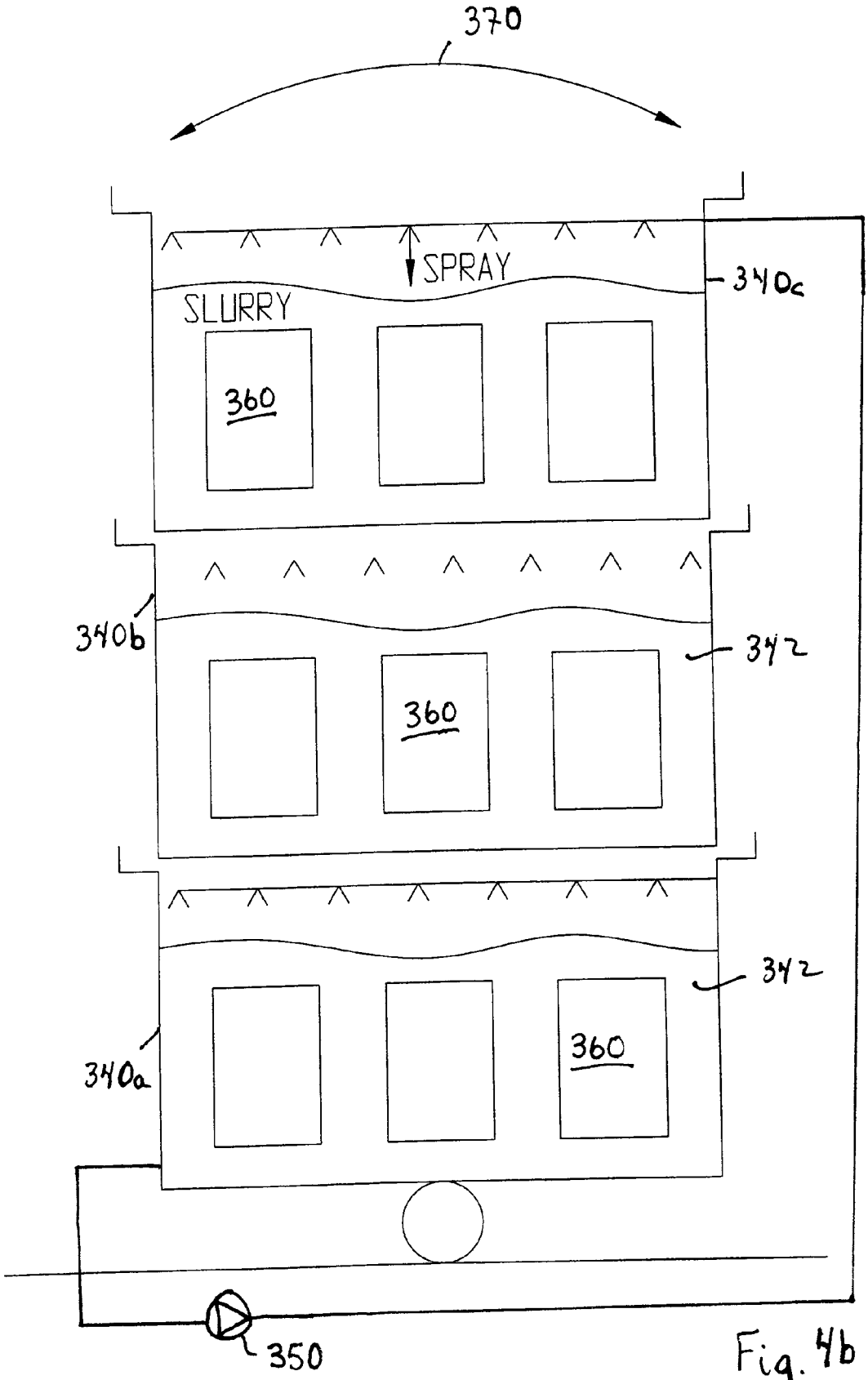
FIG. 4*b* is a side elevational view of yet another embodiment of an apparatus for cooling product.

If desired, as shown in FIG. 4*b*, the stacked tanks 340*a* to 340*c* can be oscillated as identified by arrow 370 thereby to agitate the ice slurry baths 342 within the tanks. Movement of the foodstuff 360 as a result of the oscillating tanks 340*a* to 340*c*, displaces the ice slurry baths 342 helping to improve heat transfer between the foodstuff 360 and the ice slurry baths 342.

Figure 5:
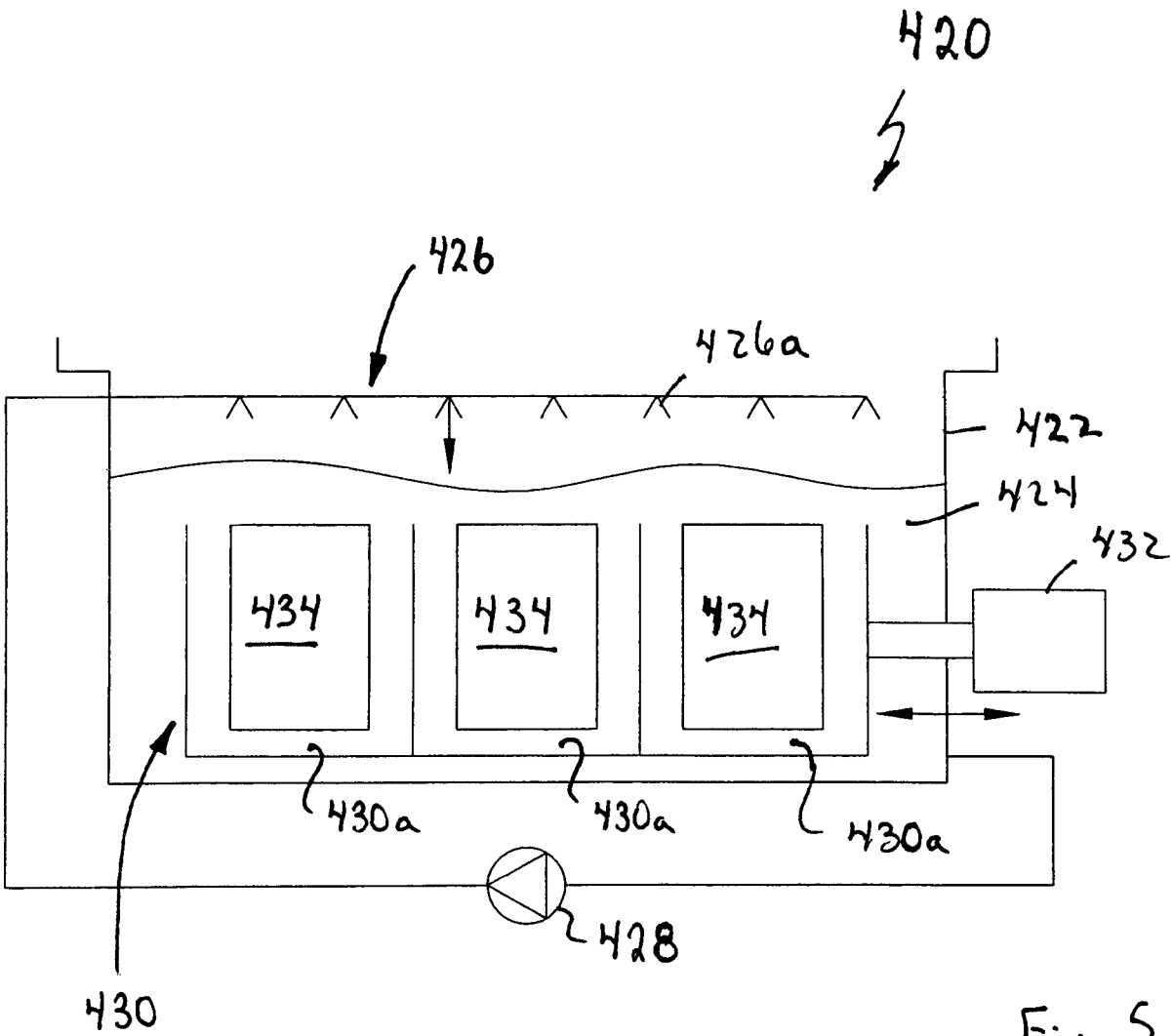
FIG. 5 is a side elevational view of yet another embodiment of an apparatus for cooling product.

FIG. 5 shows yet another apparatus 420 for cooling foodstuff. In this embodiment, the apparatus 420 comprises a tank 422 filled with an ice slurry bath 424. A nozzle assembly 426 having a series of nozzles 426*a* is provided adjacent the top of the tank 422 and sprays ice slurry into the tank thereby to agitate the ice slurry bath. A pump 428 has its inlet coupled to the bottom of the tank 422 and supplies ice slurry drawn from the tank to the nozzle assembly 426. A support frame 430 is disposed within the tank 422 below the top level of the ice slurry bath 424 and is coupled to a vibrating device 432. The support frame 430 has a plurality of compartments 430*a*, each of which receives one or more pieces of foodstuff 434. During operation, foodstuff 434 are placed in the compartments 430*a* of the support frame 430 and the support frame is vibrated via the vibrating device 432. Vibration of the support frame 430 supplements agitation of the ice slurry bath 424 thereby ensuring adequate flow of ice slurry around the foodstuff 434.

If desired, the ice slurry bath 424 can be further agitated by introducing gas bubbles into the bottom of the tank 422. The apparatus 420 is beneficial for the cooling of foodstuff where cross-contamination is a problem, as the support frame 430 supports foodstuff 434 in individual compartments 430*a*.

Figure 6:
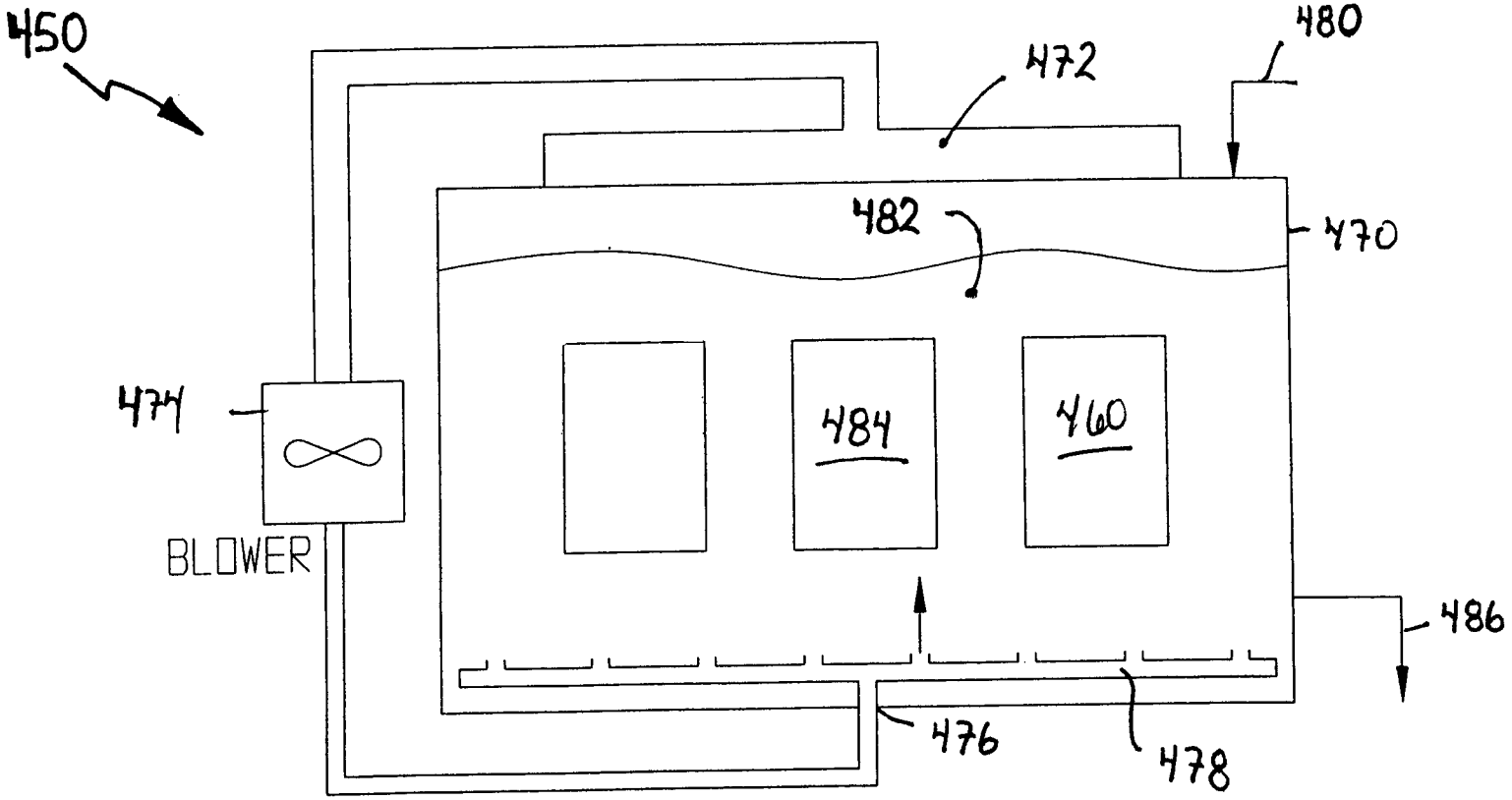
FIG. 6 is a side elevational view of yet another embodiment of an apparatus for cooling product.

Referring to FIG. 6, yet another apparatus 450 for cooling foodstuff 460 is shown. In this embodiment, the apparatus 450 comprises an enclosed tank 470 having an intake port 472 adjacent the top of the tank. The intake port 472 is coupled to a blower 474 that feeds air to an exhaust port 476 adjacent the bottom of the tank 470. An air injection manifold 478 having a series of outlets is positioned adjacent the bottom of the tank 470 and is coupled to the exhaust port 476. An ice crystal inlet port 480 is provided in the top of the tank 470 to allow ice crystals to be supplied into the tank. Air is generally continuously circulated through the tank 470 by the air blower 474 which draws air from the top of the tank 470 via the intake port 472 and returns it to the air injection manifold 478 via the exhaust port 476. The velocity of the air flowing through the tank 470 is selected to be sufficient to maintain the ice crystals in suspension, counterbalancing gravity's effect on the ice crystals, thus creating a fluidized bed 482 of the ice crystals within the tank 470.

During operation, foodstuff 484 is placed in the tank 470 such that the foodstuff is immersed in the fluidized bed 482. Contact between the foodstuff 484 and the ice crystals of the fluidized bed 482 causes the ice crystals to melt resulting in the efficient removal of heat from the foodstuff 484. Melted water is drained from the bottom of the tank 470 via outlet 486 and new ice crystals are generally continuously added to the tank 470 via inlet port 480 to maintain the fluidized bed 482.

If desired, both air and ice crystals may be re-circulated through the air blower 474. In this case, the blower may be used to break ice crystal conglomerations thus ensuring that the fluidized bed 482 consists of homogeneous ice crystals. For example, the air blower 474 construction may be similar to that of a snow blower machine, which breaks, homogenizes, and discharges the ice crystals.

Figure 7:
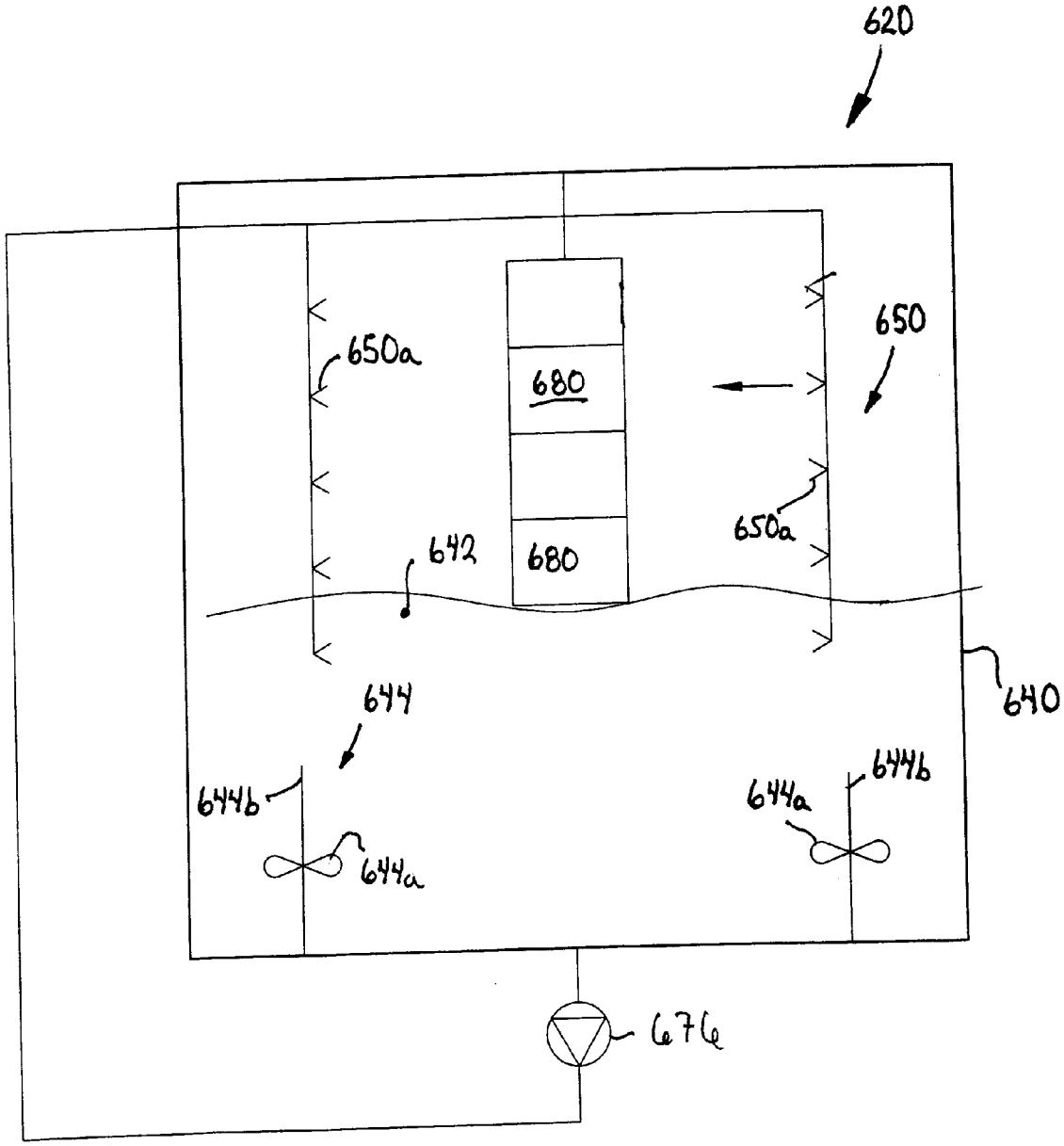
FIG. 7 is a side elevational view of still yet another embodiment of an apparatus for cooling product.

FIG. 7 shows yet another apparatus 620 for cooling foodstuff. As can be seen, in this embodiment the apparatus 620 comprises a tank 640 filled with an ice slurry bath 642. Agitators 644 comprising paddles 644*a* mounted on rotating shafts 644*b* are positioned adjacent the bottom of the tank 640 at spaced locations. Nozzle assemblies 650 are provided adjacent at least two sides of the tank. Each nozzle assembly 650 has a series of nozzles 650*a* pointing inwardly towards the center of the tank 640. Most, if not all of the nozzles 650*a* are positioned above the ice slurry bath 642. A pump 676 has its inlet coupled to a drain at the bottom of the tank 640 and its outlet coupled to the nozzle assemblies 650. In this manner, ice slurry in the tank 640 can be drawn from the bottom of the tank and discharged back into the top of the tank via the nozzles 650*a*.

During operation, foodstuff 680 is suspended in the tank 640 above the ice slurry bath 642 and the pump 676 is operated so that the nozzle assemblies 650 spray the foodstuff with ice slurry. As a result, ice slurry is passed over the outer surfaces of the foodstuff 680, with excess ice slurry falling back into the ice slurry bath. Ice crystals coming into contact with the foodstuff 680 melt thereby absorbing heat resulting in the foodstuff 680 being cooled. The presence of the ice crystals in the spray significantly improves the heat transfer in comparison to chilled water or brine.

If desired, a conveyor system can be used to deliver foodstuff 680 into the tank 640 between the nozzle assemblies 650. Also, rather than using nozzle assemblies 650 to spray ice slurry onto the foodstuff 680, the pump 676 can supply an outlet port adjacent the top of the tank 640 which is configured to pour a stream of ice slurry onto the foodstuff 680.

Figure 8:
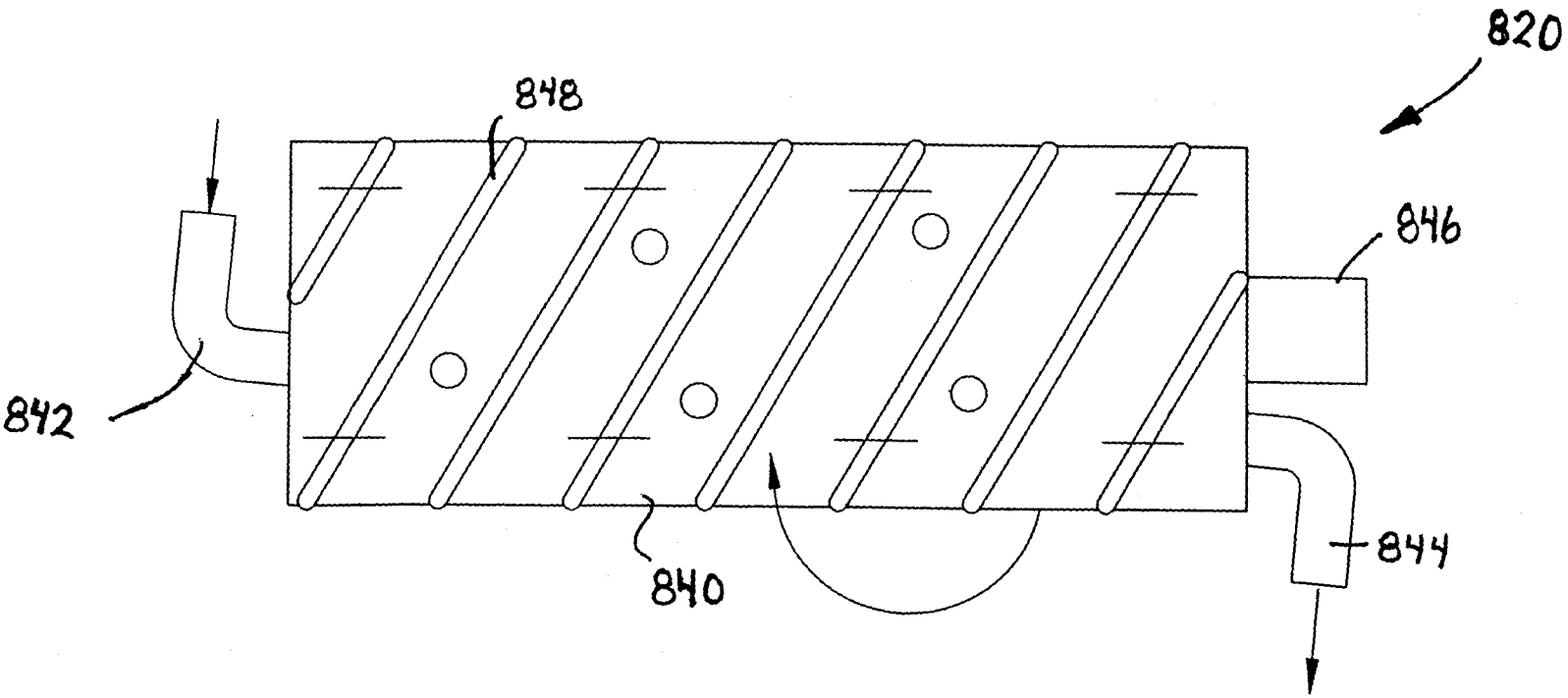
FIG. 8 is a side elevational view of still yet another embodiment of an apparatus for cooling product.

Referring to FIG. 8, still yet another embodiment of an apparatus 820 for cooling foodstuff is shown. As can be seen, in this embodiment the apparatus 820 comprises a tumbler 840 in the form of an inclined, perforated drum having an inlet 842 at one end that receives a mixture of foodstuff and ice crystals. A foodstuff outlet 844 is provided at the opposite end of the tumbler 840. A motor (not shown) is coupled to the tumbler 840 via a gear box 846 to rotate the tumbler 840. A formation such as a spiral or pedals 848 is provided on the interior surface of the tumbler 840 so that when the tumbler is rotated, foodstuff within the tumbler advances along the tumbler from the inlet 842 to the outlet 844.

Contact between the foodstuff and ice crystals within the tumbler 840 causes the ice crystals to melt resulting in the absorption of heat and cooling of the foodstuff. Water resulting from the melted ice crystals is continuously drained from the tumbler via the perforations therein while new ice crystals are added. The rotating and tumbling motion ensures close contact between the foodstuff and the ice crystals. Additional devices to prevent clumping of the ice crystals thereby to improve contact between the ice crystals and the foodstuff may be provided in the tumbler. Also, if desired separate inlets may be provided in the tumbler for the foodstuff and ice crystals.

Although embodiments have been described above with reference to the Figures, those of skill in the art will appreciate that variations and modifications may be made without departing from the spirit and scope thereof as defined by the appended claims.

What is claimed is:

1. An apparatus for cooling foodstuff comprising:

a tank containing an ice slurry bath, said tank being sized to receive a stack of perforated containers containing foodstuff with said stack of containers being immersed in said ice slurry bath;

at least one agitator to agitate the ice slurry bath;

a sensor configured to measure a drop in ice fraction of the ice slurry bath upon removal of the stack of perforated containers; and a lift configured to immerse and remove the stack of containers from the ice slurry bath, the lift being responsive to the sensor such that upon removal of the stack of containers from the ice slurry bath by the lift, if the drop of ice fraction of the ice slurry bath is below a threshold value, the lift being conditioned to re-immerse the stack of perforated containers in the ice slurry bath.

2. An apparatus according to claim 1 wherein said at least one agitator is positioned in said tank within said ice slurry bath.

3. An apparatus according to claim 2 wherein said at least one agitator comprises at least one rotating paddle.

4. An apparatus according to claim 3 wherein said at least one agitator comprises a plurality of rotating paddles.

5. An apparatus according to claim 1 wherein said at least one agitator comprises at least one nozzle discharging ice slurry into said tank.

6. An apparatus according to claim 5 further comprising a pump drawing ice slurry from said tank and delivering the ice slurry to said at least one nozzle.

7. An apparatus according to claim 6 wherein said at least one nozzle is positioned in said tank within said ice slurry bath.

8. An apparatus according to claim 7 wherein said at least one agitator comprises a plurality of spaced nozzle assemblies.

9. An apparatus according to claim 8 wherein each nozzle assembly comprises a series of spaced nozzles.

10. An apparatus according to claim 6 wherein said at least one nozzle is positioned in said tank above said ice slurry bath.

11. An apparatus according to claim 5 comprising a series of spaced nozzles.

12. A method of cooling foodstuff comprising:

immersing at least one perforated container containing foodstuff into an ice slurry bath for a period of time sufficient to allow ice slurry to enter said at least one perforated container;

subsequently removing said at least one perforated container from said ice slurry bath;

measuring a drop in ice fraction of the ice slurry bath upon removal of the at least one perforated container; and if the drop of ice fraction of the ice slurry bath is below a threshold value, re- immersing the at least one perforated container in the ice slurry bath.

13. The method of claim 12 wherein said removing further comprises allowing the liquid portion of ice slurry in said at least one perforated container to drain back into said ice slurry bath.

14. The method of claim 13 wherein said immersing and removing is repeated.

15. The method of claim 12 wherein during said immersing a stack of containers is immersed in said ice slurry bath.

* * * * *